US005727393A

United States Patent [19]

Mahmoudzadeh

[11] Patent Number: 5,727,393

[45] Date of Patent: Mar. 17, 1998

[54] MULTI-STAGE COOLING SYSTEM FOR COMMERICAL REFRIGERATION

[75] Inventor: Mahmoud Mahmoudzadeh, Yorkville, Ill.

[73] Assignee: Hussmann Corporation, Bridgeton, Mo.

[21] Appl. No.: 631,104

[22] Filed: Apr. 12, 1996

[51] Int. Cl.[6] ..... F25B 47/02

[52] U.S. Cl. ..... 62/81; 62/156; 62/185; 62/277

[58] Field of Search ..... 62/151, 81, 277, 62/278, 185, 434, 435, 436, 156

[56] References Cited

U.S. PATENT DOCUMENTS

| | | | |
|---|---|---|---|
| 1,980,688 | 11/1934 | Lewis | 62/81 |
| 2,315,379 | 3/1943 | Robson | 62/6 |
| 2,669,848 | 2/1954 | Fujii | 62/81 |
| 2,986,903 | 6/1961 | Kocher et al. | 62/333 |
| 3,210,957 | 10/1965 | Rutishauser et al. | 62/255 |
| 3,280,579 | 10/1966 | Kayl | 62/156 |
| 3,363,430 | 1/1968 | White | 62/183 |
| 3,590,595 | 7/1971 | Briggs | 62/197 |
| 3,675,441 | 7/1972 | Perez | 62/434 X |
| 4,000,626 | 1/1977 | Webber | 62/175 |
| 4,025,326 | 5/1977 | Leonard, Jr. | 62/175 |
| 4,280,335 | 7/1981 | Perez et al. | 62/332 |
| 4,344,296 | 8/1982 | Staples et al. | 62/175 |
| 4,751,823 | 6/1988 | Hans | 62/201 |
| 4,819,444 | 4/1989 | Meckler | 62/238 |
| 5,038,574 | 8/1991 | Osborne | 62/101 |
| 5,042,262 | 8/1991 | Gyger et al. | 62/64 |
| 5,335,508 | 8/1994 | Tippmann | 62/129 |
| 5,440,894 | 8/1995 | Schaeffer et al. | 62/203 |
| 5,483,806 | 1/1996 | Miller et al. | 62/402 |

FOREIGN PATENT DOCUMENTS

| | | | |
|---|---|---|---|
| 488553 | 3/1992 | European Pat. Off. | B60H 1/32 |
| 483161 | 6/1994 | European Pat. Off. . | |

*Primary Examiner*—Harry B. Tanner
*Attorney, Agent, or Firm*—Richard G. Heywood

[57] ABSTRACT

A non-compressible coolant fluid system for cooling product merchandisers having heat transfer means constructed and arranged for maintaining preselected product zone temperatures, comprising an integrated closed circuit system having pumping means for circulating non-compressible coolant fluid, a first coolant fluid loop between the pumping means and the heat transfer means and including means for cooling coolant fluid in said first loop, a second coolant fluid loop between the pumping means and the heat transfer means in by-pass relation with the first loop and including means for heating coolant fluid in the second loop, and means for selectively controlling coolant fluid circulation by said pumping means through the first and second loops.

13 Claims, 2 Drawing Sheets

MULTI-STAGE COOLING SYSTEM FOR COMMERICAL REFRIGERATION

BACKGROUND OF THE INVENTION (a) Field of the Invention

The invention relates generally to the commercial refrigeration art, and more particularly to improvements in refrigeration systems for cooling food product merchandisers or the like.

(b) Related Application

This application discloses subject matter in common with co-pending and commonly-owned application Ser. No. 08/632,219 filed Apr. 15, 1996 for Strategic Modular Secondary Refrigeration (Thomas, et al).

(c) Description of the Prior Art

World-wide environmental concerns over the depletion of the protective ozone layer and resultant earth warming due to releases of various CFC (chlorofluorocarbon) base chemicals into the atmosphere has resulted in national and international laws and regulations for the elimination and/or reduction in the production and use of such CFC chemicals. The refrigeration industry in general has been a primary target for government regulation with the result that some refrigerants, such as R-502, previously in common use in commercial foodstore refrigeration for many years are now being replaced by newer non-CFC types of refrigerants. However, such newer refrigerants are even more expensive than the more conventional CFC types, thereby raising basic cooling system installation and maintenance costs and creating higher loss risks in conventional backroom types of commercial systems having long refrigerant piping lines from the machine room to the store merchandisers. For instance, in a typical large supermarket of 50,000 square feet, the aggregate refrigeration capacity of the various food merchandisers, coolers and preparation rooms may exceed 80 tons (1,000,000 BTU/hr.) including 20 tons of low temperature refrigeration and 60 tons of medium temperature refrigeration. In this example, the piping length would be on the order of 18,000 feet of conduit requiring about 1800 pounds of refrigerant. One of the newer refrigerants is R-HP62 (an HFC chemical) that costs about $14.00 per pound.

Obviously, the refrigeration industry has been concerned over its role in the environmental crisis, and has been seeking new refrigeration systems, as well as new non-CFC chemicals, in an attempt to help control the CFC problem while maintaining high efficiency in food preservation technology.

So-called "cascade" or staged refrigeration systems are well-known, especially where relatively low temperatures are to be achieved in the controlled zone or environment such as in industrial refrigeration and cryogenic applications. Commonly-owned U.S. Pat. No. 5,440,894 discloses improvements in commercial foodstore refrigeration systems utilizing modular first stage closed-loop refrigeration units of the vapor compression type that are strategically located throughout the foodstore shopping arena in close proximity to groups of temperature-associated merchandisers, and having an efficient condenser heat exchange network through a cascade-type coolant circulating system. This prior cascade-type system is representative of the usual "two fluid" approach to multi-stage refrigeration in that the mechanical vapor-compression refrigeration stage is the final, direct refrigeration step in the controlled cooling of the merchandiser evaporator coils for maintaining product zone temperatures, and the other or "secondary" coolant is circulated in heat exchange with the condensers of the refrigeration stage to enhance efficiency. Other prior art references showing this approach include the following patents:

| U.S. Pats. | Date | Inventor |
|---|---|---|
| 3,210,957 | 10/1965 | Rutishauser |
| 4,280,335 | 07/1981 | Perez et al |
| 4,344,296 | 08/1982 | Staples et al |
| 5,335,508 | 08/1994 | Tippmann |

EPO publication No. 0483161 B1 published Jun. 29, 1994 discloses another multi-stage refrigeration system in which a central, vapor-compression, refrigeration unit cools a coolant fluid which is circulated for the direct cooling of a medium temperature unit and also cools the condenser of another vapor-compression, low temperature system located at the fixture.

In any commercial system to maintain the product zone temperatures for frozen foods, fresh meat and dairy products or other refrigerated products, it is known that the cooling (evaporator) coils or heat exchangers for such zones must be maintained at or below the freezing point of water with a resultant frost or ice build-up during cooling operations. In order to maintain the heat transfer efficiency of such heat exchangers to cool circulating air flow to the product zone and minimize unwanted temperature rise in the product area, periodic defrosting of the heat exchangers must be performed as expeditiously as possible.

SUMMARY OF THE INVENTION

The invention is embodied in a central coolant fluid system having a heat transfer unit constructed and arranged for maintaining preselected product zone temperatures, and including an integrated closed circuit system having pumping means for circulating coolant fluid, a first coolant fluid loop between the pumping means and the heat transfer unit and including a first heat exchanger constructed and arranged for cooling the coolant fluid in said first loop, a second coolant fluid loop between the pumping means and the heat transfer unit in by-pass relation with the first loop and including a second heat exchanger constructed and arranged for heating the coolant fluid in the second loop, and control means for selectively controlling coolant fluid circulation by said pumping means through the first and second loops. More specifically, the invention comprises a multi-stage commercial cooling system for cooling a heat transfer unit for a product space to be cooled; including a first cooling stage having a refrigerant compressor means, condenser means and evaporator means in a closed refrigeration circuit, the evaporator means being constructed and arranged in a first heat exchanger and the condenser means being constructed and arranged to provide a second heat exchanger; and a second cooling stage having pumping means for circulating non-compressible coolant fluid therein, and including a first loop with a chiller unit constructed and arranged with the first heat exchanger for the normal cooling and circulation of cold coolant fluid by the pumping means to the heat transfer unit for the refrigeration thereof, and a second loop in by-pass relation with the first loop and constructed and arranged with the second heat exchanger for the heating and circulation of heated coolant fluid to the heat transfer unit for the defrosting thereof; and control means for selectively controlling the circulation of coolant fluid through the first and second loops of the second cooling stage.

A principal object of the present invention is to provide a commercial cooling system for the efficient refrigeration of foodstore merchandisers and coolers through the principal use of non-compressible coolant fluids and minimal use of vapor-compression refrigerants.

Another object is to provide a non-compressible coolant fluid system having a fluid chiller loop for cooling the fluid to commercial refrigeration temperatures, and another loop for heating the fluid to defrosting temperatures.

Another object is to provide a multi-stage cascade-type central system for a food store utilizing a non-compressible coolant fluid as the principal refrigerating medium for foodstore fixtures, and having a closed vapor-compression refrigeration circuit for maintaining a continuous circulation of the coolant fluid.

Another object is to provide a coolant fluid system utilizing non-compressible coolants of the glycol-type, and to provide a hot glycol defrosting system for selectively defrosting one or more heat transfer units of the system.

A further specific object of the invention is to provide a coolant fluid defrost system that captures waste heat from a cascaded refrigeration circuit by heating a supply of the coolant fluid in a continuous manner during the normal cooling circulation of the rest of the coolant fluid.

Yet another object is to provide a multi-stage cascaded system having a high thermal efficiency using a passive feedback method of heating coolant fluid for defrost by using the waste heat generated in the normal cooling stage.

Another object is to provide a simple integral cooling and defrosting system using a preselected coolant fluid as the principal cooling/defrosting medium.

These and other objects and advantages will become more apparent hereinafter.

DESCRIPTION OF THE DRAWINGS

For illustration and disclosure purposes, the invention is embodied in the construction and arrangement and combinations of parts hereinafter described. In the accompanying drawings forming part of the specification and wherein like numerals refer to like parts wherever they occur.

DESCRIPTION OF THE PREFERRED EMBODIMENTS

The present invention pertains to multi-stage commercial refrigeration systems utilizing a non-compressible coolant fluid as the principal cooling medium. In the refrigeration industry the term "commercial" is generally used with reference to foodstore and other product cooling applications in the low and medium temperature ranges, as distinguished from air conditioning (at high temperature) and heavy duty industrial refrigeration applications in warehousing and processing plants or the like. Thus, "low temperature" as used herein shall refer to product zone temperatures in the range of −20° F. to 0° F.; and "medium temperature" (sometimes called "normal" or "standard" temperature) means product temperatures in the range of 25° F. to 50° F. It will also be understood that low temperature products require cooling coil or like heat transfer temperatures in the range of about −35° F. to −5° F.; and medium temperature cooling operations are produced with cooling coil or like heat transfer temperatures in the range of about 15° F. to 40° F. Also, for disclosure purposes, the term "coolant fluid" will refer to any suitable liquid solution that will retain its flowability at the required medium and low commercial temperatures of the heat transfer units in the product merchandisers or cooling zones; and the term "glycol" may be used herein in a generic sense to identify propylene glycol solutions well known in the industry for medium temperature applications and/or various other chemical solutions that may be useful as coolant fluids in medium and low temperature applications.

Figure 1:
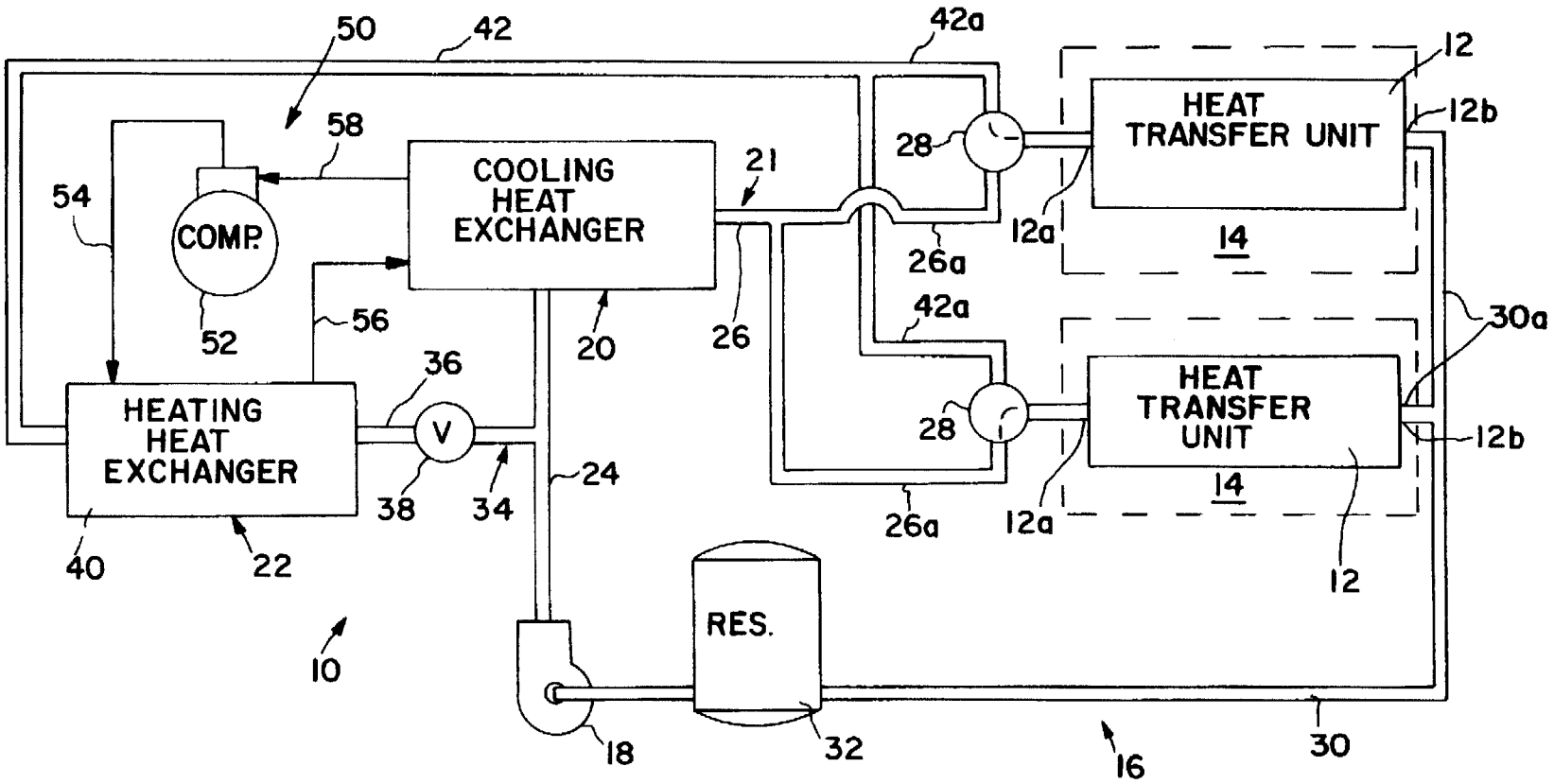
FIG. 1 is a block diagram of a multi-stage cooling system embodying the invention.

Referring now to FIG. 1 of the drawings, the invention is illustrated diagrammatically in the form of a central commercial refrigeration network or multi-stage coolant fluid system 10 for maintaining design low or medium temperatures in the heat transfer units 12 of product merchandisers 14 or the like. In its simplest form, the multi-stage system 10 includes an integrated, closed, coolant fluid circuit 16 having a fluid circulating pump 18, a cooling heat exchanger 20 and a heating heat exchanger 22. In the normal cooling or refrigerating stage for the remote product units 14 in the store, the pump 18 discharges coolant fluid outwardly through discharge conduit 24 to the cooling heat exchanger or chiller 20 in which the fluid is cooled to a predetermined selected temperature, and from which the cold fluid flows in a first loop (21) through conduits 26, **26*a* leading to flow control valve means shown in the form of three-way valves 28 on the inlet side 12*a* to the heat transfer units 12. Such heat transfer units 12 may be of any suitable configuration and typically will be a coil bank or bundle of tube and fin coil construction (not shown, but well known in the refrigeration art). Also typically, the product fixture 14 will be cooled by the circulation of air through the coil bundle between the fins of the heat transfer unit 12—the air being thus cooled and giving up sensible heat to the coolant in the unit 14. The outlets 12*b* from the heat transfer units 12 are connected by conduits 30, 30*a* back to the negative (suction) side of pump 18 through an accumulator or expansion tank 32** that will accommodate volumetric fluctuations in the coolant fluid flow.

The coolant fluid circuit 16 also has a second coolant circulating loop (34) through the heating heat exchanger 22 and in by-pass relation with the first loop 21 between the discharge conduit 24 and the three-way valves 28 at the respective heat transfer units 12. In the second loop 34, a branch conduit 36 leads from the discharge conduit 24 through a valve 38 to the heating heat exchanger 22, which preferably forms a reservoir or receiver 40 of preselected capacity to hold a prescribed volume of heated coolant fluid therein. This heat exchanger 22 is constructed and arranged to provide a substantially continuous internal heating source for the body of fluid in the receiver, and this heated body of fluid is sometimes referred to as "hot glycol" or "hot gel" and forms a heat source for defrosting the heat transfer coils 12. Thus, the outlet from the reservoir 40 connects by conduits 42, **42*a* to the flow control valve means 28 at the product units 14**.

In the preferred embodiment of the invention, the cooling heat exchanger 20 and heating heat exchanger 22 are part of a vapor-compression refrigeration system 50. The compressor means 52 of the system 50 discharges hot refrigerant vapor through line 54 to a condenser coil (not shown in FIG. 1) within the heat exchanger 22 and forming the heat source for the "hot gel". Liquid condensate from this condenser means thence flows through liquid line 56 to an evaporator coil (not shown in FIG. 1) forming the cooling source for cold coolant in the chiller heat exchanger 20, the refrigerant removing heat from the glycol fluid and being vaporized and returned to compressor means 52 through suction line 58. Alternate cooling and/or heating sources may be provided for the heat exchangers 20 and 22 in lieu of the cascaded refrigeration system 50 and, in its basic form, the invention is embodied in the coolant fluid circuit 16 having both cooling and defrosting loops 21, 34 in by-pass relationship for selectively cooling commercial fixtures 14 or defrosting the heat transfer coils 12 therefor.

Figure 2:
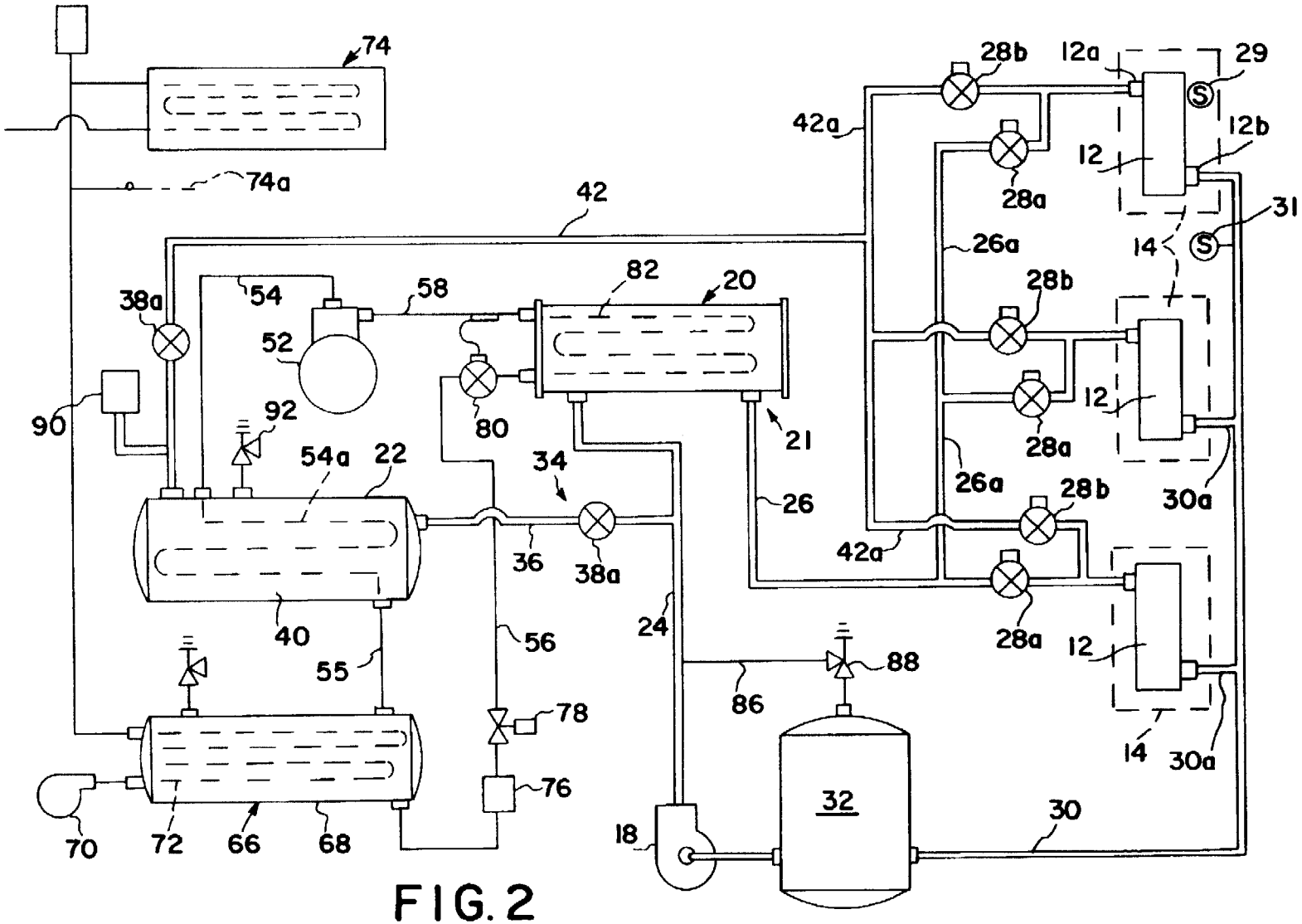
FIG. 2 is a schematic flow diagram of a multi-stage cooling system as utilized in a commercial foodstore.

Referring now to FIG. 2 wherein a presently preferred embodiment of the invention is disclosed in greater detail, the first stage refrigeration circuit 50 of the multi-stage system 10 controls the cooling and heating of the second stage glycol coolant fluid circuit 16. In a typical supermarket installation there will be separate low temperature and high temperature systems to service the range of fixture cooling requirements. Each system will be similar to FIG. 2, and will typically include multiplexed compressor means 52 (only one being shown) discharging hot refrigerant vapor through line 54 and a first or preliminary condenser coil 54*a* disposed within the reservoir 40 of the hot glycol heat exchanger 22, whereby the body of hot glycol is maintained at defrost temperature by the sensible heat (and heat of compression) recovered from the refrigerant. A second or final condenser stage is shown as a water-cooled tank condenser 66 receiving cooled refrigerant from coil 54*a* through line 55 and in which the refrigerant is condensed to a liquid and may be subcooled for most efficient refrigeration. The second condenser 66 may be water-cooled by circulating water by a pump 70 through a closed water loop 72 within the condenser tank 68 from an exterior cooling tower or air cooled cooler 74 or an alternate cooling source, such as a ground water loop 74*a*. From the refrigerant condensing stage, liquid refrigerant flows in liquid line 56 through a drier 76 and solenoid valve 78 to an expansion valve 80 on the high side of an evaporator coil 82 forming the internal cooling source for the coolant fluid in the chiller or cooling heat exchanger 20 of the second stage glycol circuit 16, to be described. The low side of the evaporator coil 82 connects through the suction line 58 back to compressor means 52 to complete the first stage circuit 50. In the cooling heat exchanger 20, the liquid refrigerant absorbs heat from the coolant fluid circulated therethrough in the main cooling loop 21 of the coolant circuit 16 and thus cools the glycol solution to maintain design temperature. It will be understood that in a central system servicing all medium temperature (or low temperature) merchandiser or other cold product zone requirements of a plurality of fixtures, the cooling heat exchanger 20 must chill the glycol solution to the lowest temperature needed to satisfy the coldest of these product zones. Typically, a fresh meat merchandiser requires the coldest medium temperature coil at about 15° F. to maintain product temperatures of about 25° F. This means that the medium temperature system must cool the glycol liquid to a temperature of about 2° F. to 10° F. and the piping runs from the central machine run must be well insulated to prevent parasitic heat losses. Furthermore, adjustments may be required in coolant flow to the other medium temperature units 14 to achieve and maintain the higher operating temperatures therefor, such as coil heat transfer temperatures of 30° F. to 40° F. for dairy cases and produce coolers.

Circulation of coolant fluid is the same as previously described. Coolant pump 18 pressurizes the glycol solution and pushes it through discharge conduit 24 to the cooling loop 21 and the heating loop 34 as required for selective cooling and defrosting purposes. In the cooling loop 21, the glycol solution is cooled in the heat exchanger 20 and distributed through supply conduits 26, 26*a* and the three-way valves 28 to the heat transfer coils 12 for the respective product zones 14 for normal cooling thereof. The glycol liquid picks up sensible heat thus warming the glycol a few degrees (i.e., 5° F. to 10° F.) and the glycol is thence returned by conduits 30, 30*a* to the liquid accumulator 32 and pump 18. The accumulator tank 32 is provided with a pressure relief by-pass pipe 86 controlled by a relief valve 88 having a preselected pressure setting.

With reference to the second defrost loop 34, in FIG. 1 the valve 38 may be a flow control valve working in conjunction with the three-way valve 28 when a defrost operation is signalled. However, in FIG. 2 the valve 38*a* on the hot gel tank supply side may be a normally-open isolation valve, and a similar isolation or service valve 38*a* may be provided on the exit side of the hot gel tank whereby the defrost loop 34 is in open continuous flow relationship with the first cooling loop 21 on the positive pressure side of the pumping means 18 during all normal cooling and defrosting operations. In FIG. 2, flow control of cold and defrost glycol to the coil heat exchangers 12 may be regulated by the use of solenoid valves in lieu of the FIG. 1 three-way valve 28. Thus, solenoid valves 28*a* are provided in cold glycol conduits 26*a* on the inlet side 12*a* to the coil banks 12, and solenoid valves 28*b* are provided in defrost conduits 42*a* to regulate hot gel flow to the inlets 12*a* of the coil banks 12. Product zone temperature sensors 29 may be selectively used to signal the need for glycol flow control to regulate the flow of coolant fluid in the first loop 21 through the heat transfer means 12 to maintain a predetermined product zone temperature. Another sensor 31 may be used on the glycol return side to sense glycol temperatures exiting the heat transfer means 12 and signal the need to regulate the flow of coolant fluid in the second loop 34 through the heat transfer means 12 during defrost. Thus, it is clear that the sensors 29 and 31 operate to signal for regulating coolant fluid flow in the first cooling loop 21 and the second defrosting loop 34 to maintain predetermined coolant temperatures exiting the coil banks 12 in both the normal refrigeration cycle and the defrost cycle of such heat transfer units. The exit or delivery conduit for hot glycol solution from the hot gel tank 22 may have a liquid expansion tank 90, and safety relief valve 92 may also be provided for the hot gel tank 40.

It is believed apparent that several system design parameters must be taken into consideration. For instance, the selection of a proper glycol solution for the applied operating temperature range will be determined by the relative viscosity and stability of the fluid at cold and defrost temperatures. An aqueous solution of propylene glycol is known to be effective in cascade systems operating at medium temperature ranges; and other non-freezing (flowable) chemical solutions are available for low temperature operations. Clearly, the size and volume of the hot gel tank 40 and the accumulator 32 will be calculated on the basis of the requirements of each application, including the number of merchandiser heat transfer units (12) that are in the system and the frequency of defrost with respect to available sensible heat load.

The normal cooling cycle of the coolant fluid circuit 16 is believed apparent from the foregoing description. In the defrost cycle, the three-way valve 28 to a selected heat transfer unit 12 is reversed—as in the upper unit 12 in FIG. 1—to connect the defrost by-pass loop 42, 42*a* from the heated heat exchanger 22. The hot glycol gel from the reservoir 40 thus flows to the defrosting coil bank 12 (which may be multiple units) while normal cooling of still other units 12 continues. It is desirable that the hot gel heat exchanger 22 be internally baffled or otherwise constructed and arranged to prevent the short circuiting or turbulent mixing of inflow glycol from the pump 18 with the supply of hot gel in the heat exchanger 22—although the continuous flow of hot vaporous refrigerant from the compressor 52 through coil 54*a* will tend to maintain a continuous supply of hot defrost glycol even with frequent or prolonged defrost cycles.

Many advantages of the present invention will be recognized. This coolant fluid circuit eliminates the need for separate cooling and defrost circuits and pumping means therefor. The hot glycol for defrost and the cold glycol for cooling are supplied by the same circulation system at the same pressure thus eliminating check valves, pressure reducing valves and the like. It will now be readily apparent that the multi-stage commercial system of the present invention provides a greatly improved, environmentally safe network of coolant fluid circuitry meeting the objects set out. The scope of the invention is intended to encompass changes and modifications as will be apparent to those skilled in the commercial refrigeration art, and is only to be limited by the scope of the claims which follow.

What is claimed is:

1. A non-compressible coolant fluid system for cooling product merchandisers having heat transfer means constructed and arranged for maintaining preselected product zone temperatures, comprising an integrated closed circuit system having positive displacement pumping means for circulating non-compressible coolant fluid, a first coolant fluid loop between the pumping means and the heat transfer means and including means for cooling coolant fluid in said first loop, a second coolant fluid loop between the pumping means and the heat transfer means in by-pass relation with the first loop and including means for heating coolant fluid in the second loop, and means for controlling coolant fluid circulation in said first and second loops through said heat transfer means, and wherein said second coolant fluid loop is constructed and arranged for continuous fluid communication with the first coolant fluid loop on the positive pressure side of said pumping means.

2. The coolant fluid system of claim 1 wherein pumping means and said first and second coolant fluid loops are constructed and arranged for balanced coolant fluid pressure flow through the loops.

3. The coolant fluid system of claim 2, wherein the coolant fluid flow through the first and second loops is not restricted by back flow preventing means.

4. The coolant fluid system of claim 1 wherein said means for heating coolant fluid in the second loop includes a coolant fluid heating reservoir constructed and arranged to be substantially continuously heated for maintaining a supply of hot coolant fluid for use in selectively defrosting the heat transfer means in said product merchandisers.

5. The coolant fluid system of claim 4 in which there are multiple merchandisers having heat transfer means designed for product cooling in substantially the same temperature range, and wherein said coolant fluid heating reservoir is sized to contain a supply volume of heated coolant fluid that is capable of defrosting the heat transfer means of more than one product merchandiser through the second loop at the same time, said supply volume being static during normal cooling cycles.

6. The coolant fluid system of claim 5 wherein said means for controlling coolant fluid circulation comprises valve means for selectively connecting the first and second loops to the inlet side of the heat transfer means of a product merchandiser.

7. The coolant fluid system as set forth in claim 6 wherein said means for controlling coolant fluid circulation includes means responsive to the sensed temperature in the product merchandiser for operating said valve means to control the flow of heated coolant fluid through said second loop to said heat transfer means in a defrost cycle.

8. The coolant fluid system of claim 1, wherein said means for cooling coolant fluid in said first loop includes a cooling fluid cooling reservoir constructed and arranged to contain a predetermined volume of cold coolant fluid in transit to the heat transfer means to be cooled.

9. The coolant fluid system of claim 1, which includes a first stage vapor-compression refrigeration system having compressor, condenser and evaporator means, and in which said condenser means is associated with the means for heating coolant fluid in the second loop, and in which the evaporator means is associated with the means for cooling coolant fluid in said first loop.

10. A method for operating a non-compressible coolant fluid system for cooling food product merchandisers having heating transfer means constructed and arranged for maintaining preselected product zone temperatures, the method comprising the steps of:

circulating non-compressible coolant fluid in a first coolant fluid loop from the positive displacement side of the pumping means through the heat transfer means;

cooling the coolant fluid in the first loop;

circulating the coolant fluid in a second coolant fluid loop from the positive displacement side of the pumping means through the heat transfer means;

heating the coolant fluid in the second loop;

maintaining the first and second loops in open fluid communication on the positive pressure side of the pumping means, whereby the coolant fluid flow is circulated through the first and second loops at substantially the same pressure; and selectively controlling coolant fluid circulation by the pumping means through the first and second loops.

11. The method of claim 10 further comprising the steps of:

monitoring the product zone temperature; and controlling the flow of coolant fluid in the first loop through the heat transfer means to maintain a predetermined product zone temperature.

12. The method of claim 10 further comprising the steps of:

monitoring the coolant fluid temperature exiting the heat transfer means; and controlling the flow of coolant fluid in the second loop through the heat transfer means to substantially maintain a predetermined coolant fluid temperature exiting the heat transfer means in both a normal refrigeration cycle and a defrost cycle of the heat transfer means.

13. A multi-stage commercial cooling system including heat transfer means associated with multiple product spaces to be cooled, comprising:

a first cooling stage having refrigerant compressor, condenser and evaporator means sequentially connected in a closed refrigeration circuit, said condenser means being constructed and arranged to include first heat exchanger means, and said evaporator means being constructed and arranged to form second heat exchanger means;

a second cooling stage having positive displacement pumping means for circulating a non-compressible cooling fluid to and from the heat transfer means for the product spaces, said second cooling stage including a first loop constructed and arranged with the second heat exchanger means for the normal cooling and circulation of cold coolant fluid to the heat transfer means for the refrigeration thereof, and a second loop constructed and arranged with the first heat exchanger means and in by-pass relation with the first loop for the heating and selective circulation of heated coolant fluid through the heat transfer means for the defrosting thereof, said positive displacement pumping means being in normally open fluid communication with both of said first and second loops for the circulation of cooling fluid therein;

valve means connecting the first and second loops to the inlet side of the heat transfer means, and sensing means for selectively controlling the circulation of coolant fluid through the first and second loops of said second cooling stage.

* * * * *